US012497738B1

(12) United States Patent
Face, III

(10) Patent No.: US 12,497,738 B1
(45) Date of Patent: Dec. 16, 2025

(54) CONCRETE DOWEL PLATE WITH SHEAR-ACTIVATED HINGE

(71) Applicant: S. Allen Face, III, Sleepy Hollow, IL (US)

(72) Inventor: S. Allen Face, III, Sleepy Hollow, IL (US)

( * ) Notice: Subject to any disclaimer, the term of this patent is extended or adjusted under 35 U.S.C. 154(b) by 0 days.

(21) Appl. No.: 19/211,613

(22) Filed: May 19, 2025

Related U.S. Application Data

(60) Provisional application No. 63/798,630, filed on May 2, 2025.

(51) Int. Cl.
*E01C 11/14* (2006.01)
*E01C 11/06* (2006.01)

(52) U.S. Cl.
CPC ..... *E01C 11/14* (2013.01); *E01C 11/06* (2013.01)

(58) Field of Classification Search
None
See application file for complete search history.

(56) References Cited

U.S. PATENT DOCUMENTS 1,780,588 A * 11/1930 Heltzel ..... E01C 11/02 52/587.1
2,082,316 A * 6/1937 Williams ..... E01C 11/14 404/52
2,142,305 A * 1/1939 Davis ..... E04C 2/384 52/592.1
2,207,085 A * 7/1940 Brickman ..... E01C 11/14 404/52
2,321,087 A * 6/1943 Jacobson ..... E01C 11/14 404/63
3,680,449 A * 8/1972 Guritz ..... E01H 13/00 244/114 R
6,145,262 A * 11/2000 Schrader ..... E01C 11/14 52/700
7,004,443 B2 * 2/2006 Bennett ..... E01C 11/14 249/185
8,206,059 B1 * 6/2012 Southgate ..... E01C 11/14 404/60
9,574,309 B2 * 2/2017 McDonald ..... E04B 1/48
10,072,384 B2 * 9/2018 McDonald ..... E04B 1/48
2006/0275078 A1 * 12/2006 Shaw ..... E01C 19/504 404/56
2007/0231068 A1 * 10/2007 Francies ..... E01C 11/14 404/56

FOREIGN PATENT DOCUMENTS

DE 3424362 A1 * 1/1986

* cited by examiner

*Primary Examiner* — Christopher J Sebesta
*Assistant Examiner* — Katherine J Chu
(74) *Attorney, Agent, or Firm* — Peter J. Van Bergen

(57) ABSTRACT

A dowel plate includes a rigid first plate, a rigid second plate, and a coupling attached to and disposed between the first plate and the second plate. The coupling comprises a rigid coupling that prevents relative rotation of the first plate and the second plate about the coupling's longitudinal axis when a torsional shear force acting on the coupling is less than a force threshold. The coupling comprises a hinged coupling that permanently permits the relative rotation when the torsional shear force exceeds the force threshold.

18 Claims, 7 Drawing Sheets

CONCRETE DOWEL PLATE WITH SHEAR-ACTIVATED HINGE

Pursuant to 35 U.S.C. § 119, the benefit of priority from provisional application 63/798,630, with a filing date of May 2, 2025, is claimed for this non-provisional application.

FIELD OF THE DISCLOSURE

This disclosure relates generally to concrete dowel plates, and more particularly to methods and systems for mitigating curling-induced edge moments in concrete slabs through use of a concrete dowel plate incorporating a hinge that remains in a locked position until a threshold amount of torsional shear force is applied to the hinge.

BACKGROUND

Curl at the edges of concrete slabs is well-known. Briefly, edges of concrete slabs curl up slightly as the concrete dries and cures. Where two concrete slabs are adjacent to one another at what is known as a joint, curling causes the adjacent edges of the two slabs to counter rotate in upward directions. In an effort to keep the tops of the lifted and counter-rotated slab edges aligned when the joint is subjected to wheeled traffic, dowels or dowel plates have been fitted intermittently across the joints in concrete slabs for years. The installation and functionality of conventional dowels or dowel plates will be described briefly below.

Typically, an open-ended pocket former (i.e., a sleeve) is disposed in a first slab and is accessible at the vertical edge face of the first slab. A rigid dowel or dowel plate is inserted into the pocket former. A portion of the dowel or dowel plate extends from the pocket former. The portion of the dowel or dowel plate so-extended is captured within an adjacent second concrete slab as the second concrete slab is placed. The continuous rigid dowel spanning the joint between the two slabs provides both a shear and moment connection between the two slabs at the joint. When the concrete composing the slabs then dries/cures from the tops of the slabs down, the concrete shrinks differentially from top to bottom thereby causing the edges of the slabs to lift upwards and counter-rotate.

The above-described embedded joint dowel connecting two slabs resists slab edge counter-rotations by requiring both slab edges to apply opposing negative moments on both ends of the dowel in order to bend the dowel into conformity with the arch shape created by the counter-rotations. As a direct consequence of this need to bend the dowel, the combined live load capacity of the two counter-rotated slab edges connected by the dowel is reduced by an amount exactly equal to the work that must be done to bend the dowel by the uplifting and counter-rotating edges. While the bent rigid dowel does still provide the cross-joint shear transfer required to keep the tops of the abutting slab edges aligned under live-load-inducing traffic as the traffic traverses the slab edges, its subtractive effect upon the joint's live load capacity also requires the thickness of the upwardly curled slab edges to be increased in order to compensate for the live load capacity lost by the edges in bending the dowel. The moments applied by the slab edges in bending the dowel can also become so large that the bottom portions of one or both slab edges beneath the dowel will break out thereby destroying the dowel's embedment and effectiveness.

SUMMARY

Accordingly, it is an object of the present disclosure to describe methods and systems for doweling two slabs' edges together to provide the cross-joint shear transfer required to keep the tops of the abutting and counter-rotating slab edges aligned, while simultaneously not requiring the slab edges to generate moments that bend the embedded dowels to conform to the edges' uplifted and counter-rotated shapes, not requiring any compensatory increase in the edge thicknesses to allow the joint to provide equivalent live load capacity, and not causing the bottom portions of one or both slab edges beneath the dowel to break out.

Other objects and advantages of the methods and systems described herein will become more obvious hereinafter in the specification and drawings.

In accordance with methods and systems described herein, a dowel plate includes a rigid first plate, a rigid second plate, and a coupling attached to and disposed between the first plate and the second plate. The coupling has a longitudinal axis. The coupling comprises a rigid coupling that prevents relative rotation of the first plate and the second plate about the coupling's longitudinal axis when a torsional shear force acting on the coupling is less than a force threshold. The coupling comprises a hinged coupling that permanently permits the relative rotation of the first plate and the second plate about the coupling's longitudinal axis when the torsional shear force exceeds the force threshold.

BRIEF DESCRIPTION OF THE DRAWINGS

Other objects, features and advantages of the methods and systems described in the present disclosure will become apparent upon reference to the following description of the preferred embodiments and to the drawings, wherein corresponding reference characters indicate corresponding parts throughout the several views of the drawings and wherein:

FIG. 2A is a schematic side view of a concrete dowel plate with a shear-activated hinge serving as a rigid coupling that links two adjacent concrete slabs separated by a joint space in accordance with various aspects as described herein;

DETAILED DESCRIPTION

Figure 1:
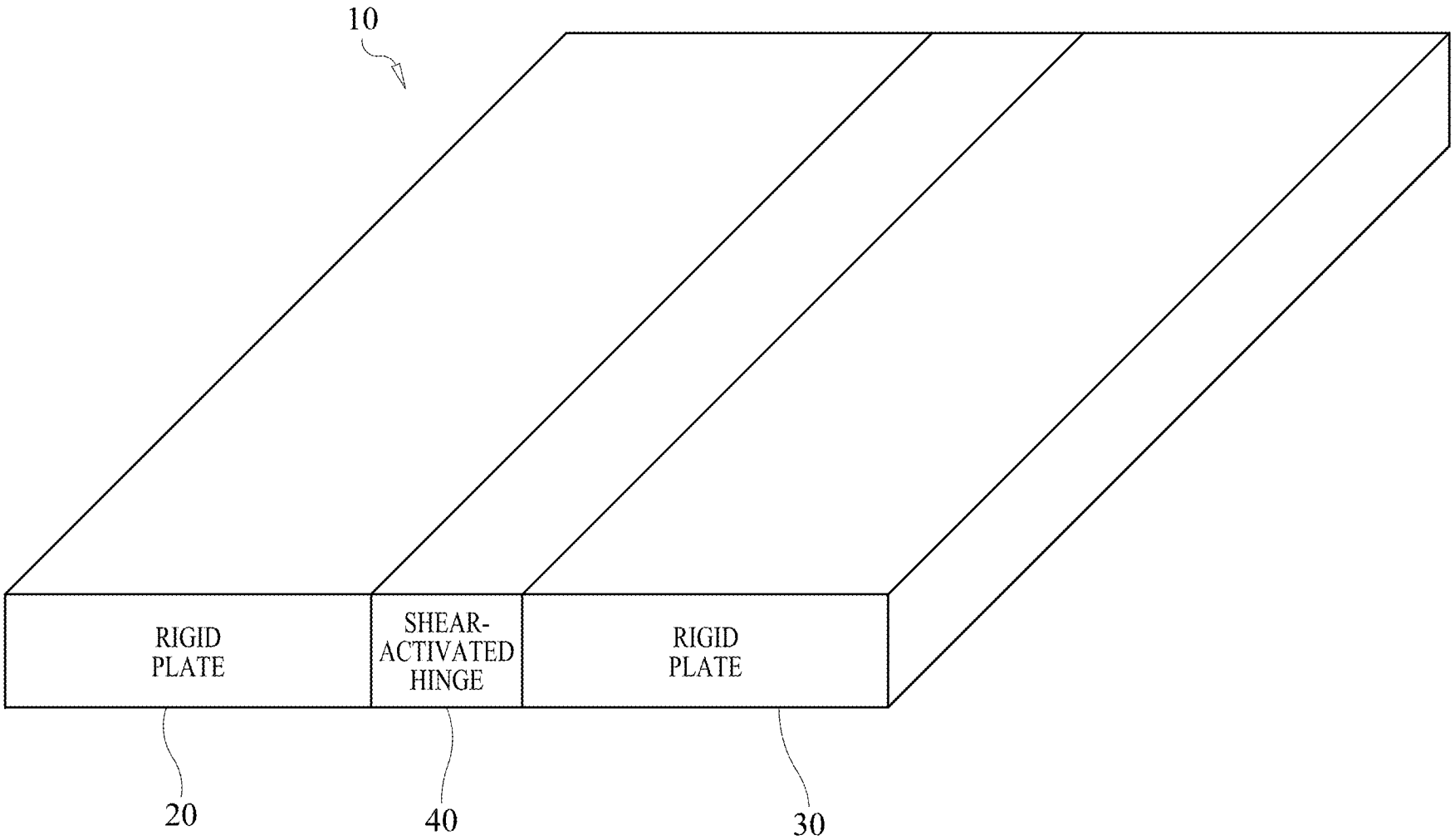
FIG. 1 is a schematic perspective view of an embodiment of a concrete dowel plate with a shear-activated hinge in accordance with various aspects as described herein.

Referring now to the drawings and more particularly to FIG. 1, an embodiment of a concrete dowel plate with a shear-activated hinge is shown and is referenced generally by numeral 10. Dowel plate 10 may be used with what are known as "pocket formers" to span across a joint space between two edges of adjacent concrete slabs. A variety of such pocket-former-based dowel systems are known in the art. The type of pocket former and method for installing the pocket former are not limitations of the present disclosure.

In general, dowel plate 10 is configured to assume a rigid planar plate structure during and immediately after its installation where it will span across a joint space between two fresh concrete slabs typically placed on a ground substrate, i.e., slabs on ground as they are known in the art. That is, dowel plate 10 serves as a link between two adjacent concrete slabs. Then, as the slabs' adjacent slab edges curl upward in a counter rotating fashion during the drying/curing of the slabs, dowel plate 10 is configured such that a portion of dowel plate 10 residing in and along the joint space between the two slab edges assumes a hinging state after a sufficient amount of rotational or torsional shear forces due to a load imparted by slab curling act on the portion of dowel plate 10 residing in the joint space between the two slab edges.

To achieve the above-described functionality, dowel plate 10 includes a first rigid plate 20, a second rigid plate 30, and a shear-activated hinge 40 disposed between and attached to plates 20 and 30. Materials used for plates 20/30 and shear-activated hinge 40 may include metals, plastics, composites, and combinations thereof without departing from the scope of the present disclosure. In some embodiments, one of plates 20 and 30 may be disposed or positioned in a pocket former (not shown) that is installed in a first concrete slab, and the other of plates 20 and 30 may be disposed or positioned in a second concrete slab having an edge adjacent to the first concrete slab. Shear-activated hinge 40 resides in a joint space between the edges of the two adjacent concrete slabs with the hinge's longitudinal hinging axis 41 extending along the joint space.

Figure 2B:
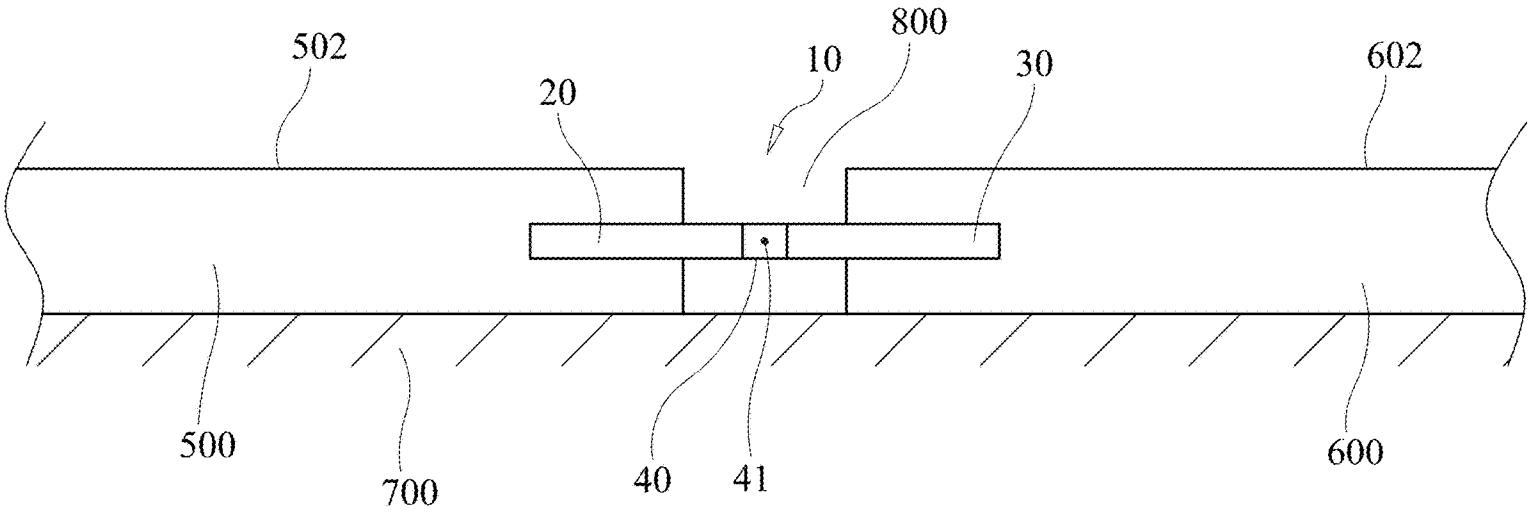
FIG. 2B is a schematic side view of a concrete dowel plate with a shear-activated hinge serving as a rigid coupling that links two adjacent concrete slabs separated by a joint space where one slab has a pocket former disposed therein in accordance with various aspects as described herein.
Figure 2B:
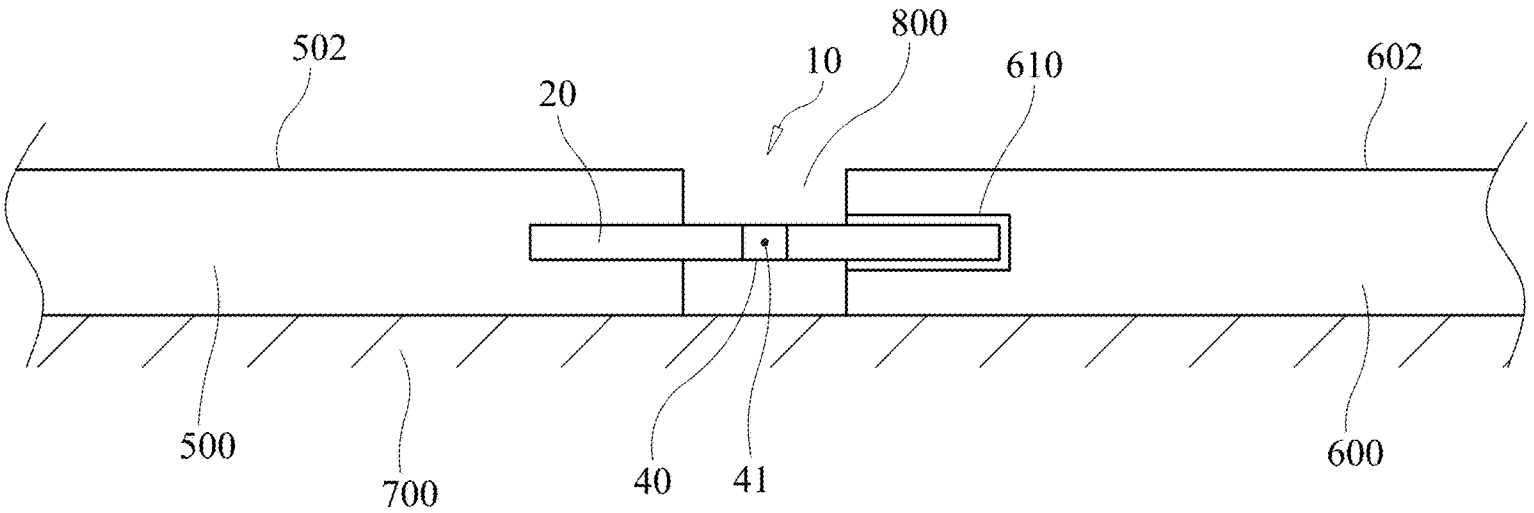

Referring now to FIG. 2A, when dowel plate 10 is initially installed in two adjacent concrete slabs 500 and 600 placed on a ground substrate 700 with shear-activated hinge 40 and its longitudinal hinging axis 41 positioned in a joint space 800 between the slabs' adjacent edges as described above, dowel plate 10 is in its rigid planar configuration. In some embodiments, plates 20 and 30 are co-planar and parallel to the exposed or top surfaces 502 and 602 of slabs 500 and 600, respectively, when dowel plate 10 is in its rigid configuration. In some embodiments and as shown in FIG. 2B, one of the slabs (e.g., slab 600 in the illustrated example) may have a pocket former 610 installed therein to receive plate 30 when dowel plate 10 is in its rigid configuration. The inclusion of pocket formers in concrete slabs is well-understood in the art. For clarity of illustration, such pocket formers have been omitted from the remainder of the figures.

Figure 3:
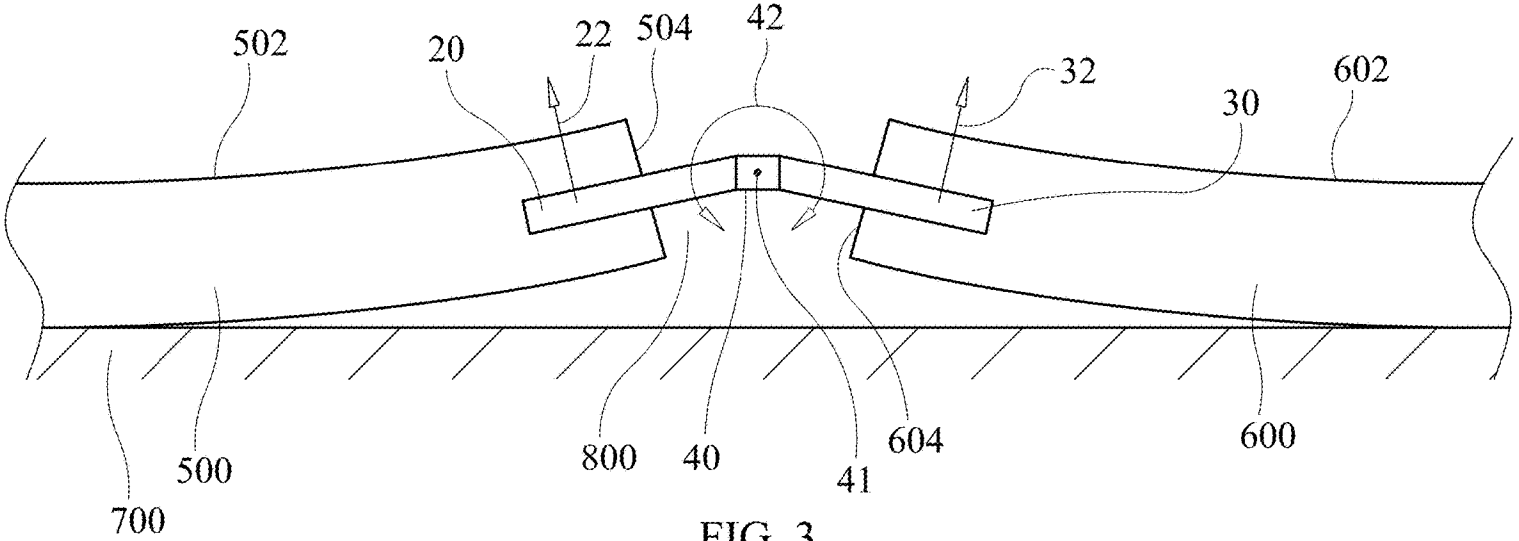
FIG. 3 is a schematic side view of a concrete dowel plate with a shear-activated hinge serving as a hinged coupling that links two adjacent and curled concrete slabs separated by a joint space in accordance with various aspects as described herein.

Referring now to FIG. 3, as the slabs' concrete dries/cures, the edges 504 and 604 of the slabs curl to impart curling forces 22 and 32 on plates 20 and 30, respectively, as is well-understood in the art. For clarity of illustration, the amount of curling is exaggerated in the figures. Forces 22 and 32 are counter rotating, edge-curling-induced forces that cause rotational or torsional shear forces 42 to act on shear-activated hinge 40. As will be described further below by way of non-limiting examples of the shear-activated hinge, shear-activated hinge 40 is designed to prevent hinging action when subjected to torsional shear forces that are less than a designed-for threshold value but to allow hinging action when the threshold value is exceeded. Once the threshold value of torsional shear force has been exceeded, shear-activated hinge 40 is permanently placed in a hinging state that permits relative rotation between plates 20 and 30 as supported by hinge 40. That is, in general, shear-activated hinge 40 is designed to have a torsional shear force threshold associated therewith that will not be exceeded by general handling during the slab construction process but that will be exceeded by torsional shear forces induced by the curling forces 22 and 32. The torsional shear force threshold may be defined by conditional fastening features integrated with the hinge's structure, by conditional fastening features added to or coupled to the hinge's structure, or by combinations thereof without departing from the scope of the present disclosure.

Figure 4:
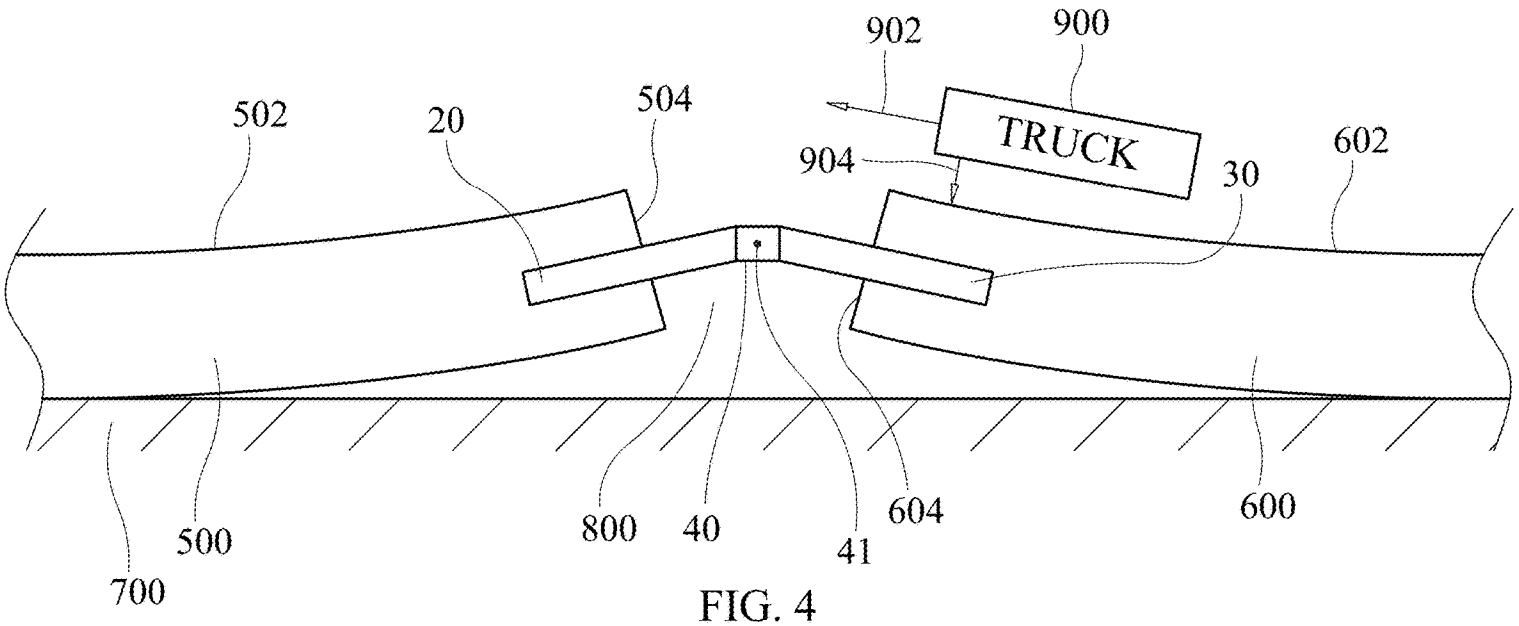
FIG. 4 is a schematic side view of a concrete dowel plate with a shear-activated hinge serving as a hinged coupling that links two adjacent and curled concrete slabs separated by a joint space where live-load-inducing traffic is traversing the slabs in accordance with various aspects as described herein.

Once the above-described threshold value is exceeded, hinge 40 is permanently in its hinging state that permits relative rotation of plates 20 and 30 about hinge 40. In its hinging state, hinge 40 allows plates 20 and 30 to experience relative rotation about longitudinal hinging axis 41 when a live load acts on slabs 500 and/or 600, i.e., when an external load such as an over-rolling truck wheel, a storage rack leg, a floor-stored pallet, etc. is imposed on the top(s) of one or both of slabs 500 and 600. For example and with reference to FIG. 4, as a truck 900 is about to transition from slab 600 to slab 500 as indicated by arrow 902, truck 900 first imparts a live load 904 to slab 600 near its curled edge 604. As this occurs, hinge 40 in its hinging state allows plate 30 to rotate slightly downward about longitudinal axis 41 without imparting any moment forces on plate 20. The process repeats itself in reverse for plate 20 as truck 900 moves over joint space 800 and onto slab 500.

Shear-activated hinge 40 may be constructed in a variety of ways without departing from the scope of the present disclosure. Several non-limiting exemplary embodiments will be described below. For example and with reference to FIG. 5, a concrete dowel plate 100 has rigid plates 120 and 130 coupled together at a shear-activated hinge 140. Plate 120 includes hinge knuckles 122 that mesh or mate with hinge knuckles 132 of plate 130. When mated and aligned, knuckles 122 and 132 define a sleeve 142 receiving a hinge pin 144. A longitudinal axis of hinge 140 is defined along hinge pin 144 as indicated by a dashed line 141. In accordance with the present disclosure, plates 120 and 130 are placed in planar alignment with hinge pin 144 extending through knuckles 122 and 132. A temporary bonding agent or material 146 (e.g., glue, adhesive, bonding cement, etc.) is disposed in sleeve 142 to temporarily bond knuckles 122 and 132 to pin 144 so that dowel plate 100 is maintained as a planar structure, i.e., knuckles 122 and 132 cannot rotate or hinge about pin 144. Temporary bonding agent 146 is selected to maintain the planar structure of dowel plate 100 until such time that dowel plate 100 is subjected to torsional shear forces in excess of a threshold force associated with loads brought on by concrete slab curling as described above.

Figure 5:
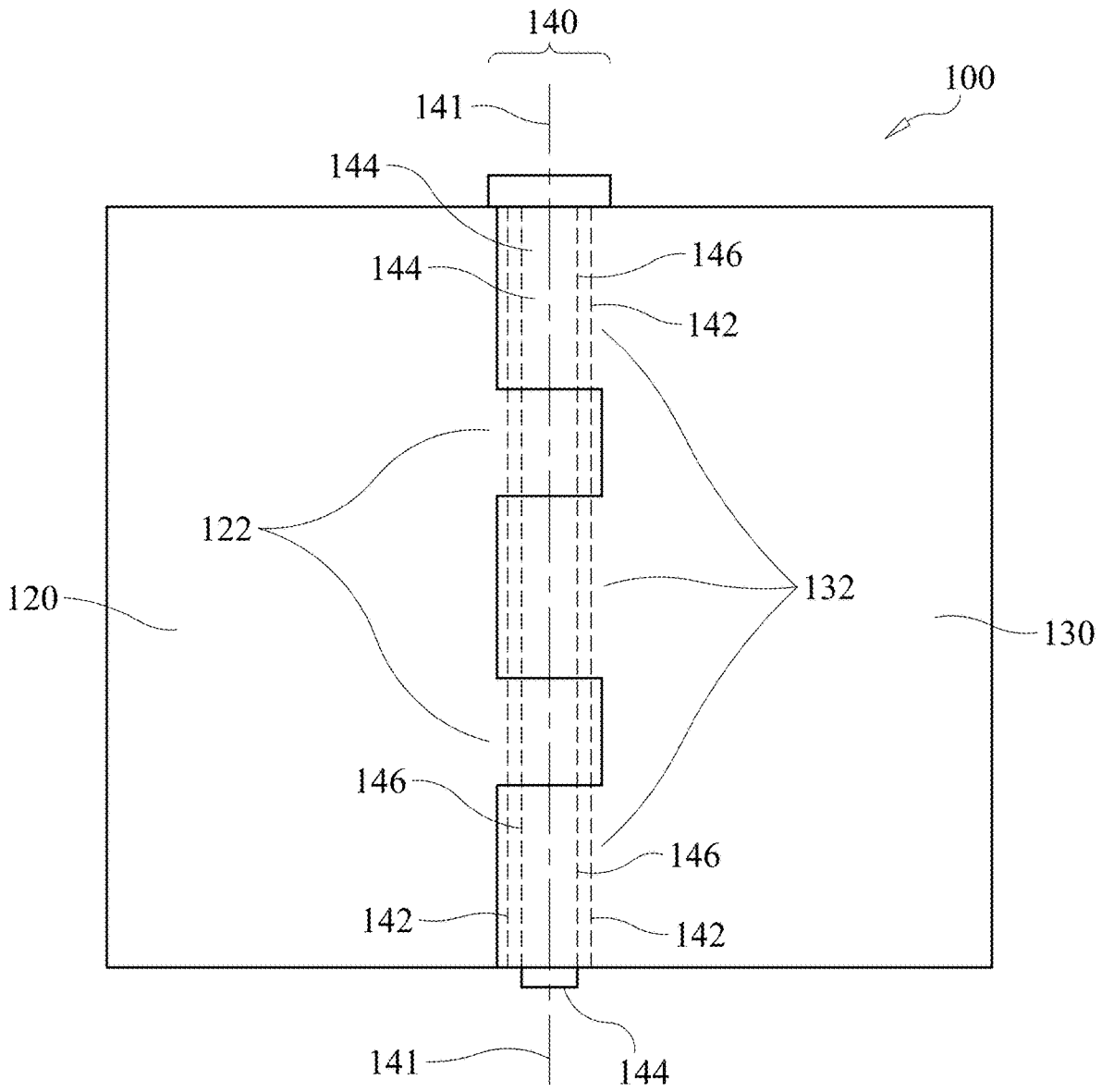
FIG. 5 is a plan view of an embodiment of a concrete dowel plate having a shear-activated hinge in accordance with various aspects as described herein.
Figure 6A:
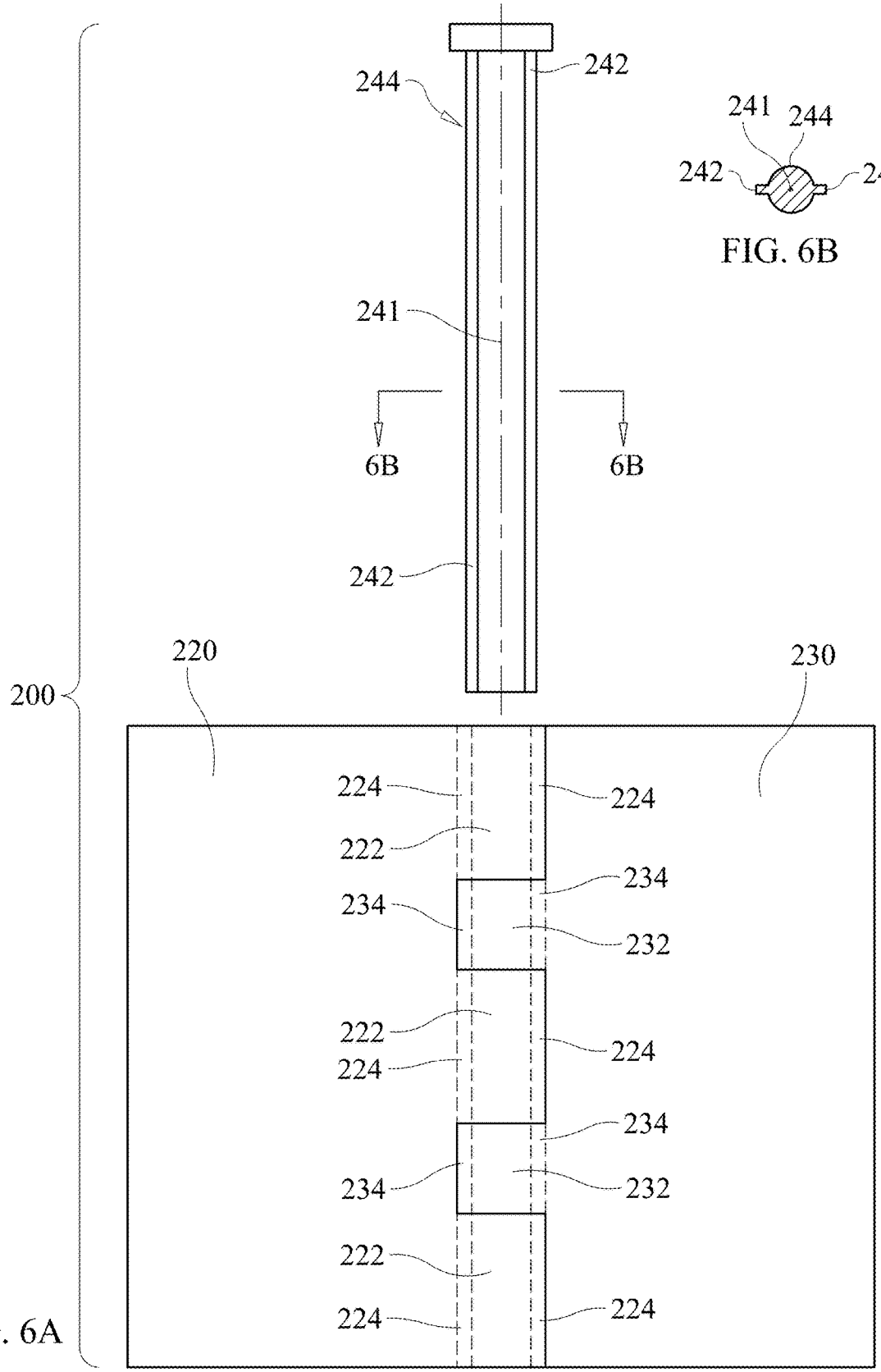
FIG. 6A is an exploded plan view of another embodiment of a concrete dowel plate having a shear-activated hinge that uses a splined or keyed hinge pin for engagement with internally notched knuckles of the dowel plate's hinge in accordance with various aspects as described herein.
Figure 6B:
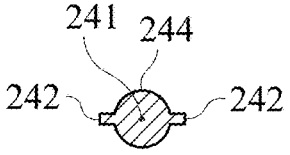
FIG. 6B is a cross-sectional view of the splined or keyed hinge pin taken along line 6-6 in FIG. 6A in accordance with various aspects as described herein.
Figure 7A:
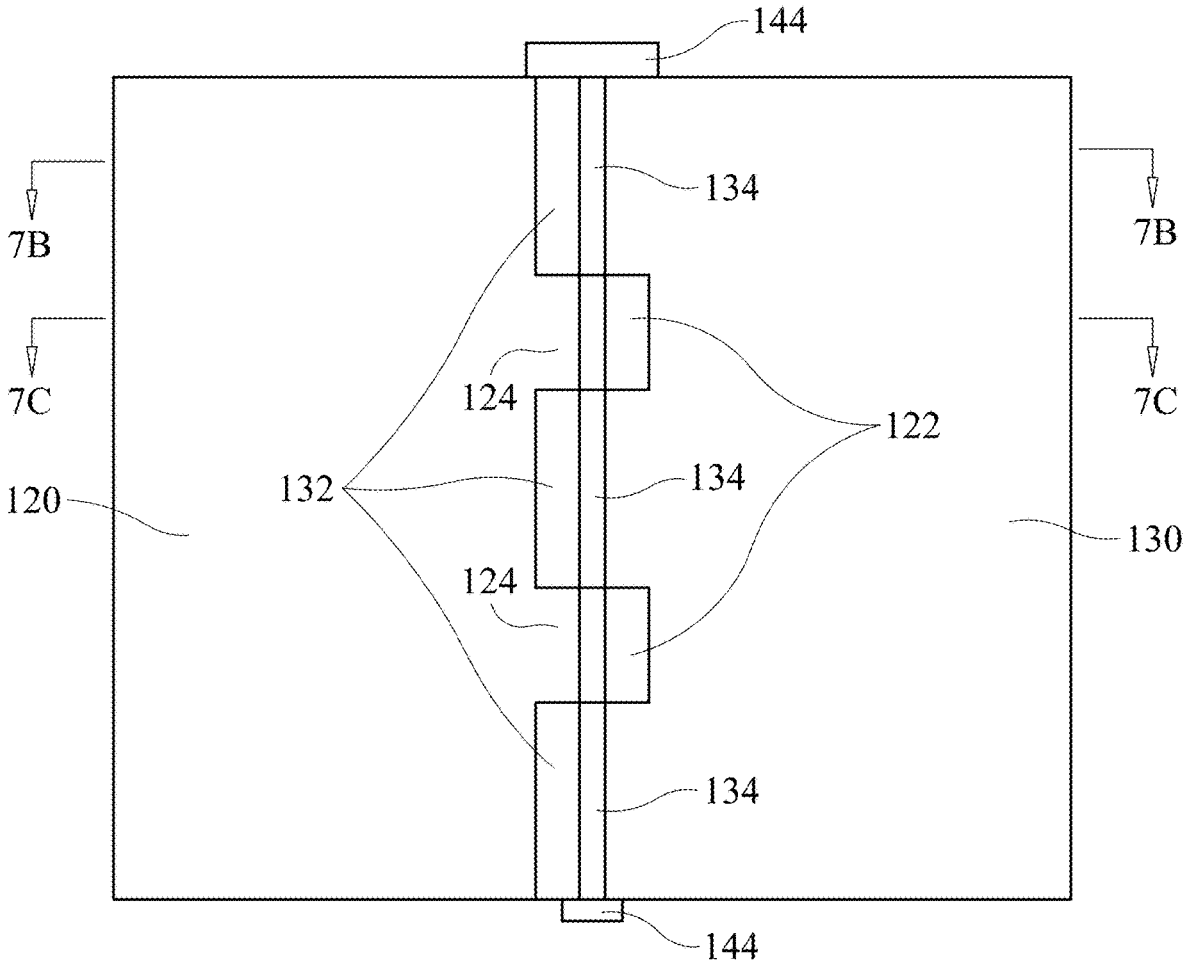
FIG. 7A is an isolated plan view of another embodiment of a concrete dowel plate whose mating knuckles are externally notched to receive a locking retention clip in accordance with various aspects as described herein.
Figure 7B:
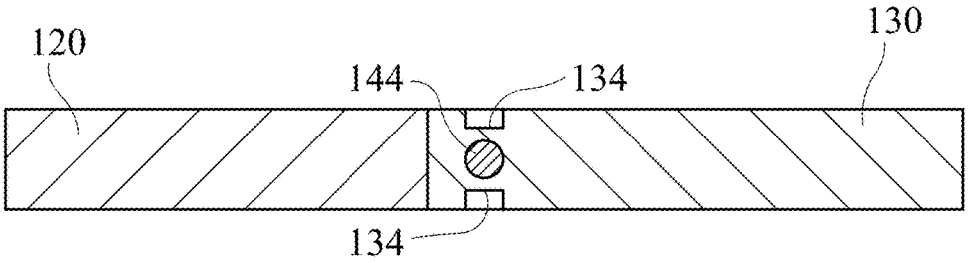
FIG. 7B is a cross-sectional view of the hinge's knuckles taken along line 7B-7B in FIG. 7A in accordance with various aspects as described herein.
Figure 7C:
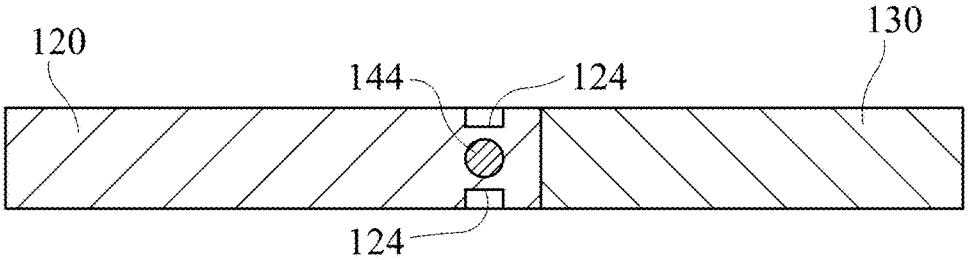
FIG. 7C is a cross-sectional view of the hinge's knuckles taken along line 7C-7C in FIG. 7A in accordance with various aspects as described herein.

In some embodiments, the dowel plate's shear-activated hinge may include mechanical features incorporated into the hinge. For example and with reference now to FIGS. 6A and 6B, the above-described hinge pin may additionally or alternatively include mechanical splines or keys for engagement with notches or slots aligned along the inside of a sleeve defined by mating/meshing hinge knuckles (e.g., sleeve 142 as illustrated in FIG. 5). More specifically, a concrete dowel plate 200 includes plates 220 and 230 having mating knuckles 222 and 232, respectively. A hinge pin 244 has one or more radially extending keys or splines. In the illustrated example, two splines 242 are provided at radially opposing sides of pin 244. Each of splines 242 is sized for sliding engagement with aligned notches or slots 224 and 234 provided on the inside walls of hinge knuckles 222 and 232, respectively. Knuckles 222 and 232 are configured such that alignment of notches or slots 224 and 234 position plates 220 and 230 in planar alignment with one another. Splines 242 are configured to remain intact and engage with aligned notches or slots 224/234 so that concrete dowel plate 200 is maintained in a planar and rigid configuration until such time that the dowel plate is subjected to torsional shear forces in excess of a threshold value as described above. Once the torsional shear force threshold is achieved, splines 242 break away from pin 244 thereby allowing pin 244 to function as a conventional hinge pin to permanently permit the hinge's knuckles to rotate about the hinge's longitudinal axis 241 which is also the longitudinal axis of pin 244.

Figure 8:
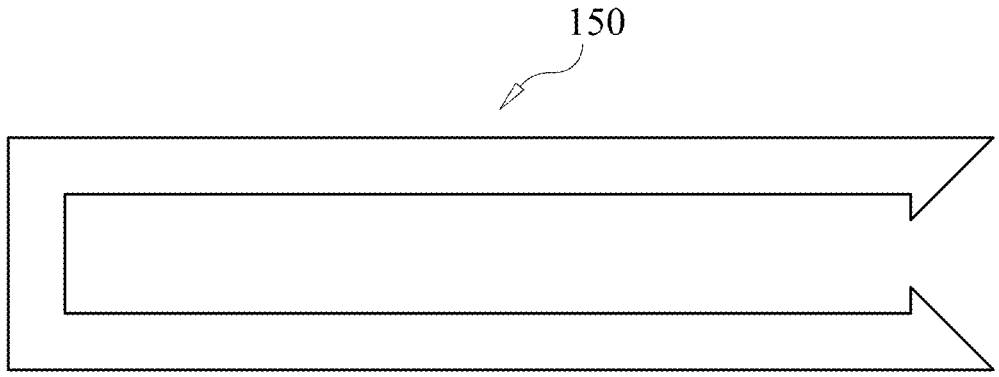
FIG. 8 is an isolated side view of an embodiment of a locking retention clip for engagement with externally notched knuckles of a hinge for inclusion with a concrete dowel plate in accordance with various aspects as described herein.
Figure 9:
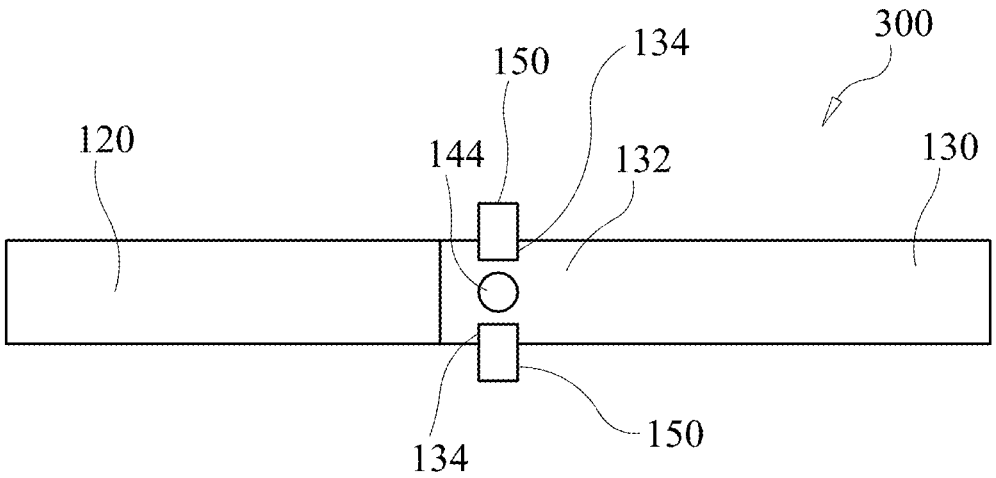
FIG. 9 is an end view of a concrete dowel plate with externally notched knuckles engaged by a locking retention clip in accordance with various aspects as described herein.

In some embodiments, the mating knuckles of a hinge may be externally notched such that the knuckles may be temporarily restrained from rotation about a hinge pin using a locking retention clip. For example and with simultaneous reference to FIG. 7A through FIG. 9, another embodiment of a concrete dowel plate 300 (FIG. 9) will be described. Similar to dowel plate 100 (FIG. 5), hinge knuckles 122 (associated with plate 120) mate or mesh with hinge knuckles 132 (associated with plate 130). A conventional hinge pin 144 extends through knuckles 122 and 132. In this embodiment, external notches 124 in knuckles 122 are aligned with external notches 134 in knuckles 132 when knuckles 122 mate or mesh with knuckles 132. Plates 120 and 130 are configured to be in planar alignment with one another when notches 124 are aligned with notches 134. In the illustrated embodiment, notches 124 and 134 are provided on opposing sides of knuckles 122 and 132, respectively. To temporarily retain knuckles 122 and 132 with their notches aligned as shown, a locking retention clip 150 (FIGS. 8 and 9) engages with the aligned notches 124 and 134. Clip 150 is designed to fail when the above-described torsional shear force threshold is exceeded thereby allowing dowel plate 300 to permanently function in its hinging state as previously described herein.

The advantages of the systems and methods described herein are numerous. The dowel plate allows two adjacent concrete slabs' edges to be linked together to provide the cross-joint shear transfer required to keep the tops of the abutting and counter-rotating slab edges aligned. The dowel plate's shear-activated hinge does not allow the slab edges to generate moments that bend the embedded dowels to conform to the edges' uplifted and counter-rotated shapes. Accordingly, the dowel plate described herein does not require any compensatory increase in the edge thicknesses to allow the joint to provide equivalent live load capacity, and will not cause the bottom portions of one or both slab edges beneath the dowel to break out.

Although the methods and systems presented herein have been described for specific embodiments thereof, there are numerous variations and modifications that will be readily apparent to those skilled in the art in light of the above teachings. It is therefore to be understood that, within the scope of the appended claims, the methods and systems presented herein may be practiced other than as specifically described.

What is claimed as new and desired to be secured by Letters Patent of the United States is:

1. A dowel plate, comprising:

a rigid first plate;

a rigid second plate;

a coupling attached to and disposed between said first plate and said second plate, said coupling having a longitudinal axis; and said coupling comprising a rigid coupling that positions and constrains said first plate, said second plate, and said coupling in a co-planar arrangement and prevents relative rotation of said first plate and said second plate about said longitudinal axis when a torsional shear force acting on said coupling is less than a force threshold, and said coupling comprising a hinged coupling that permanently permits said relative rotation when said torsional shear force exceeds said force threshold wherein at least one of said first plate and said second plate is no longer constrained to said co-planar arrangement.

2. The dowel plate of claim 1, wherein said coupling comprises:

first hinge knuckles integral with said first plate;

second hinge knuckles integral with said second plate and meshing with said first hinge knuckles;

a hinge pin passing through said first hinge knuckles and said second hinge knuckles, said hinge pin aligned along said longitudinal axis; and a conditional fastener engaged with at least one of said first hinge knuckles, said second hinge knuckles, and said hinge pin, said conditional fastener preventing said relative rotation until said force threshold is exceeded and permanently permitting said relative rotation after said force threshold is exceeded.

3. The dowel plate of claim 2, wherein said conditional fastener comprises a bonding material disposed between said hinge pin and said first hinge knuckles and said second hinge knuckles.

4. The dowel plate of claim 2, wherein said conditional fastener comprises at least one spline on said hinge pin in a keyed engagement with said first hinge knuckles and said second hinge knuckles.

5. The dowel plate of claim 2, wherein said conditional fastener comprises a retainer locking said first hinge knuckles to said second hinge knuckles.

6. A dowel plate system, comprising:

two adjacent and fresh concrete slabs separated by a joint space;

a rigid first plate disposed in a first slab of said two adjacent and fresh concrete slabs;

a rigid second plate disposed in a second slab of said two adjacent and fresh concrete slabs; and a coupling attached to and disposed between said first plate and said second plate, said coupling disposed in the said joint space, said coupling having a longitudinal axis extending along said joint space, said coupling comprising a rigid coupling prior to the drying and curing of said two adjacent and fresh concrete slabs, said rigid coupling positioning and constraining said first plate, said second plate, and said riqid coupling in a co-planar arrangement until a torsional shear force at said rigid coupling exceeds a force threshold, and said coupling comprising a hinged coupling as the two adjacent and fresh concrete slabs dry and cure to impart curling forces to said first plate and said second plate causing said torsional shear force at said riqid coupling to exceed said force threshold, said hinged coupling permanently permitting relative rotation of at least one of said first plate and said second plate about said longitudinal axis when said torsional shear force exceeds said force threshold wherein at least one of said first plate and said second plate is no longer constrained to said co-planar arrangement.

7. The dowel plate of claim 6, wherein said coupling comprises:

first hinge knuckles integral with said first plate;

second hinge knuckles integral with said second plate and meshing with said first hinge knuckles;

a hinge pin passing through said first hinge knuckles and said second hinge knuckles, said hinge pin aligned along said longitudinal axis; and a conditional fastener engaged with at least one of said first hinge knuckles, said second hinge knuckles, and said hinge pin, said conditional fastener preventing said relative rotation until said force threshold is exceeded and permanently permitting said relative rotation after said force threshold is exceeded.

8. The dowel plate of claim 7, wherein said conditional fastener comprises a bonding material disposed between said hinge pin and said first hinge knuckles and said second hinge knuckles.

9. The dowel plate of claim 7, wherein said conditional fastener comprises at least one spline on said hinge pin in a keyed engagement with said first hinge knuckles and said second hinge knuckles.

10. The dowel plate of claim 7, wherein said conditional fastener comprises a retainer locking said first hinge knuckles to said second hinge knuckles.

11. A method, comprising:

by a dowel plate including a rigid first plate, a rigid second plate, and a coupling attached to and disposed between the first plate and the second plate with the coupling having a longitudinal axis, where the coupling comprises a rigid coupling that positions and constrains the first plate, the second plate, and the coupling in a co-planar arrangement and prevents relative rotation of the first plate and the second plate about the longitudinal axis when a torsional shear force acting on the rigid coupling is less than a force threshold, and where the coupling comprises a hinged coupling that permanently permits the relative rotation when the torsional shear force exceeds the force threshold wherein at least one of the first plate and the second plate is no longer constrained to the co-planar arrangement, positioning, while the coupling comprises the riqid coupling, the dowel plate as a link between two adjacent and fresh concrete slabs that are separated by a joint space with the first plate disposed in a first slab of the two adjacent and fresh concrete slabs, the second plate disposed in a second slab of the two adjacent and fresh concrete slabs, and the rigid coupling disposed in the joint space separating the two adjacent and fresh concrete slabs with the longitudinal axis of the rigid coupling extending along the joint space, and wherein, while the two adjacent and fresh concrete slabs dry and cure, the riqid coupling is permanently converted to the hinged coupling when the torsional shear force exceeds the force threshold.

12. The method of claim 11, wherein the longitudinal axis of the coupling is positioned parallel to the top surfaces of the first slab and the second slab.

13. The method of claim 11, wherein one of the first plate and the second plate is positioned in a pocket former disposed in a corresponding one of the first slab and the second slab.

14. The method of claim 11, wherein the first plate and the second plate are positioned parallel to the top surfaces of the first slab and second slab when the coupling comprises the rigid coupling.

15. The method of claim 11, wherein the coupling comprises:

first hinge knuckles integral with the first plate;

second hinge knuckles integral with the second plate and meshing with the first hinge knuckles;

a hinge pin passing through the first hinge knuckles and the second hinge knuckles with the hinge pin being aligned along the longitudinal axis; and a conditional fastener engaged with at least one of the first hinge knuckles, the second hinge knuckles, and the hinge pin, the conditional fastener preventing the relative rotation until the force threshold is exceeded and permanently permitting the relative rotation after the force threshold is exceeded.

16. The method of claim 15, wherein the conditional fastener comprises a bonding material disposed between the hinge pin and the first hinge knuckles and the second hinge knuckles.

17. The method of claim 15, wherein the conditional fastener comprises at least one spline on the hinge pin in a keyed engagement with the first hinge knuckles and the second hinge knuckles.

18. The method of claim 15, wherein the conditional fastener comprises a retainer locking the first hinge knuckles to the second hinge knuckles.

* * * * *